US007219892B2

(12) United States Patent
Corrado

(10) Patent No.: US 7,219,892 B2
(45) Date of Patent: May 22, 2007

(54) HOCKEY GAME

(75) Inventor: Michael H. Corrado, Quakertown, PA (US)

(73) Assignee: Corr Table Sports, LLC, Quakertown, PA (US)

( * ) Notice: Subject to any disclaimer, the term of this patent is extended or adjusted under 35 U.S.C. 154(b) by 0 days.

(21) Appl. No.: 11/233,818

(22) Filed: Sep. 23, 2005

(65) Prior Publication Data

US 2006/0022403 A1 Feb. 2, 2006

Related U.S. Application Data

(63) Continuation-in-part of application No. 10/909,616, filed on Aug. 2, 2004.

(60) Provisional application No. 60/492,718, filed on Aug. 5, 2003.

(51) Int. Cl.
*A63F 7/00* (2006.01)

(52) U.S. Cl. ..... 273/108.1; 273/108.52

(58) Field of Classification Search ..... 273/108, 273/108.1, 108.5–108.57, 118 R–126 R; D21/313, 314, 318
See application file for complete search history.

(56) References Cited

U.S. PATENT DOCUMENTS 3,480,277 A * 11/1969 Fraser ..... 273/108.52
3,870,303 A * 3/1975 Patterson, Jr. ..... 273/108.52
3,940,135 A 2/1976 Cohen
4,012,040 A 3/1977 Fernandes
4,311,309 A * 1/1982 Bradley et al. ..... 273/108.51
4,765,622 A 8/1988 Rienzo
4,775,152 A 10/1988 Roehl
4,872,679 A 10/1989 Bohaski
5,046,734 A 9/1991 Laine
5,074,556 A 12/1991 Loeppky
5,222,735 A 6/1993 Savage
5,320,350 A 6/1994 Savage
5,326,102 A * 7/1994 Chang ..... 273/108.52
5,411,256 A 5/1995 Savage
5,482,273 A * 1/1996 Wilton ..... 273/317.1
5,556,094 A 9/1996 Shiledar Baxi
5,655,767 A 8/1997 Francis
6,623,004 B2 * 9/2003 Rossi et al. ..... 273/108.1
6,659,457 B1 * 12/2003 Cheng ..... 273/108.53
6,663,108 B2 * 12/2003 Makhoul ..... 273/317.3
D490,476 S * 5/2004 Oister et al. ..... D21/318

* cited by examiner

*Primary Examiner*—Nini F. Legesse
(74) *Attorney, Agent, or Firm*—Beck & Thomas, P.C

(57) ABSTRACT

This invention relates to a competitive board game comprised of a table with sides surrounding the playing surface. Hockey sticks are suspended from transverse bars suspended across the playing surface and slidably disposed between the sides of the table. The table has a goal at each end of the playing surface and the playing surface mates with sides in formed rounded corners. The playing surface is angled between each rounded corner toward the center of the board to provide for a fast game requiring high levels of skill. A ⅛th inch lip is provided over the edge of the playing surface to keep the puck in play for special Quninning shots.

20 Claims, 5 Drawing Sheets

HOCKEY GAME

RELATED APPLICATION DATA

This application is a continuation in part of application Ser. No. 10/909,616 filed on Aug. 2, 2004 which is a Nonprovisional application claiming priority to Provisional application Ser. No. 60/492,718 filed on Aug. 5, 2003.

FIELD OF THE INVENTION

This invention relates to a competitive board game comprised of a table with sides surrounding the playing surface. Hockey sticks are suspended from transverse bars suspended across the playing surface and are slidably disposed between the sides of the table. The table has a goal at each end of the playing surface and the playing surface mates with sides thereby forming rounded corners. The playing surface is angled downwardly between each rounded corner and the center of the board to provide for a fast game requiring high levels of skill. A ⅛th inch inward overhang from the top of the sides over the playing surface permits complex hockey shots.

DISCUSSION OF THE RELEVANT ART

Table hockey tables are widely known in many forms such as, for example, U.S. Pat. No. 5,655,767 to Francis et. al. and U.S. Pat. No. 5,046,734 to Laine teach a hockey table having players supported and controlled from below the board. Many references have the people themselves using the playing surface, such as U.S. Pat. No. 5,556,094 to Shiledar Baxi. A number of patents teach the use of obstacles on the playing surface to make the game more challenging such as U.S. Pat. No. 4,765,622 to Rienzo and U.S. Pat. No. 5,074,556 to Loeppky et. al. Some games teach a folding table for travel and storage such as U.S. Pat. No. 4,872,679 to Bohaski et. al. A number of patents teach magnetic control of the hockey puck, such as U.S. Pat. No. 4,012,040 to Fernandes.

A number of patents teach a sloping playing surface, such as U.S. Pat. No. 3,940,135 to Cohen, which is a magnetically controlled game with a sloped top plate under which the hockey game is played. Some patents teach a playing surface sloped from the center of the playing area, between the goals, as the high spot, sloping downwardly towards the goals, such as U.S. Pat. Nos. 5,222,735 and 5,320,350 to Savage. The instant invention has many new and novel features not disclosed in the prior art references.

SUMMARY OF THE INVENTION

An object of the instant invention is the implementation of a sophisticated playing surface which is sloped inwardly from each rounded corner toward the center of the playing surface, thereby requiring fast and skillful reactions on the part of the players, who control hockey sticks which are slidably suspended across the playing surface.

Another object of the instant invention is the implementation of rounded corners that provide the players with the ability to place the puck in front of the goals as it is banked off the rounded corners.

Another object of the instant invention is to provide a puck insertion aperture, sloping downwardly and aimed at the correct face-off location on the playing surface.

Another object of the instant invention is a metal interface between the goal and the wall surrounding the playing surface.

Another object of the instant invention is an exterior retaining wall surrounding and parallel to the interior retaining wall that provides a support for the exterior top surface.

Another object of the instant invention is an exterior goal retrieval aperture formed in the wall surrounding the playing surface.

Another object of the instant invention is to provide a stick designed such that each stick is not able to reach the sideboards thereby decreasing the likelihood of stick breakage.

Another object of the instant invention is for the upper exterior top surface to overhang the playing surface by approximately ⅛ inch, which in combination with the goalie stick extending approximately 2.5 inches past each of the goal posts, that enables the goalie stick to backwardly pinch the ball against the wall forcing the ball up the wall, hitting the ⅛ inch overhanging exterior top thereby enabling the puck to fly mid air towards the opposing goal opening in a shot called "Quinning".

Another object of the instant invention is to provide a deflector behind the goal aperture on the playing surface that deflects the puck downwardly towards a goal aperture formed in the outside wall of the instant invention.

Another object of the instant invention is to provide hockey sticks supported from slidable transverse control arms with realistic curved front ends and angled support members.

Another object of the instant invention is to provide a hockey stick that does not extend to the playing surface.

DETAILED DESCRIPTION OF THE PREFERRED EMBODIMENT

Figure 1:
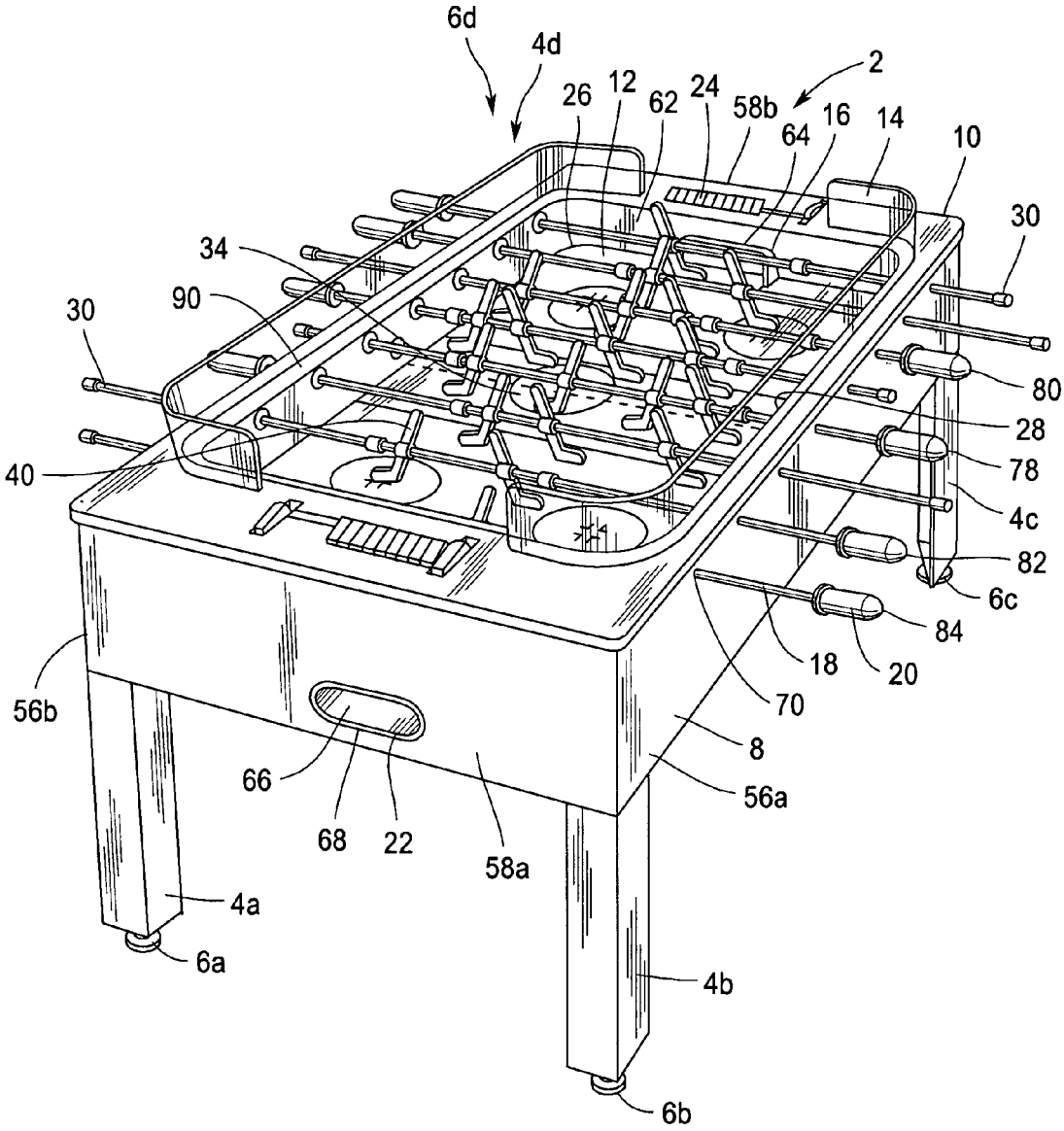
FIG. 1 is a perspective view of the instant invention.
Figure 2:
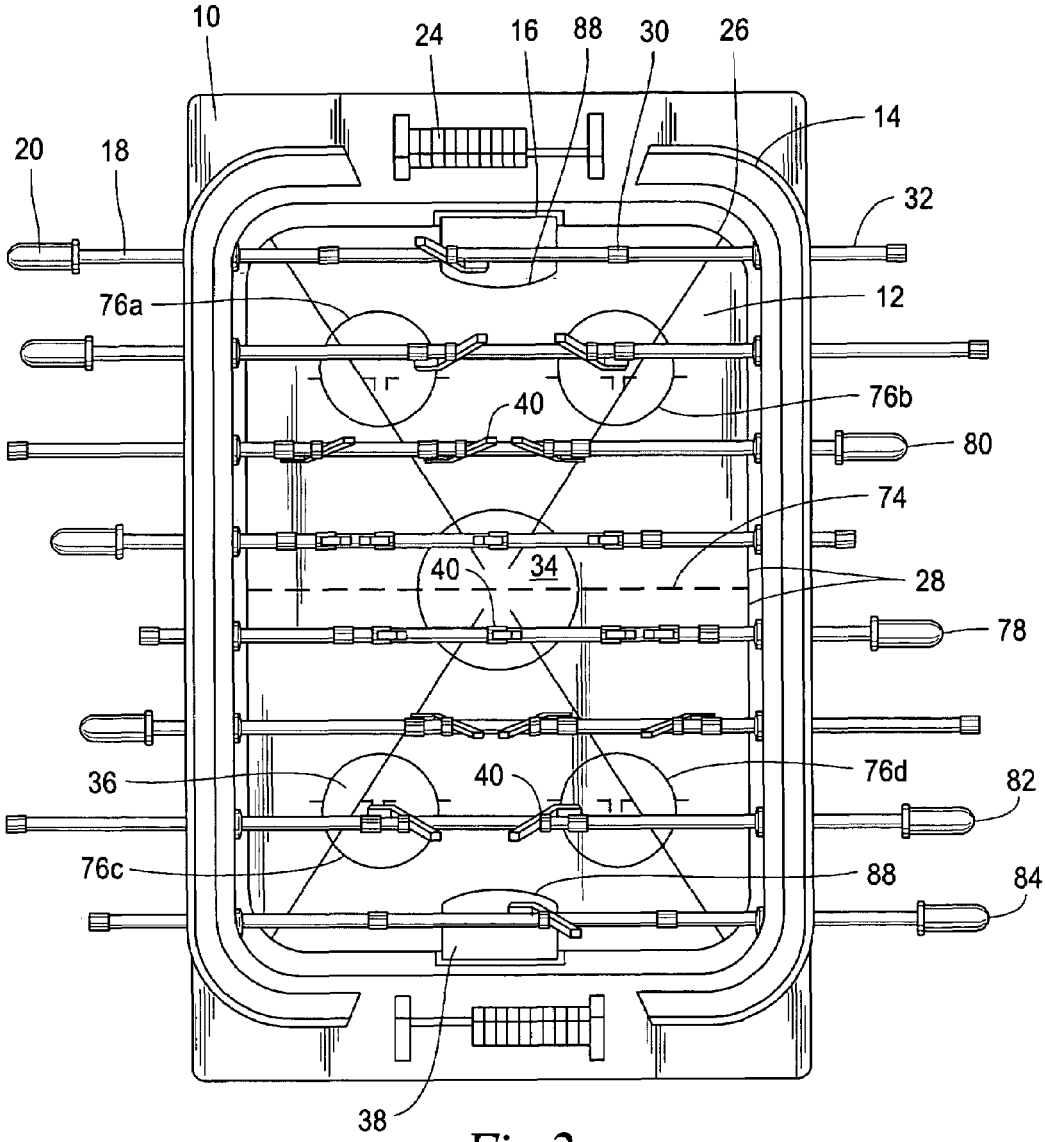
FIG. 2 is a top plan view of the instant invention.
Figure 3A:
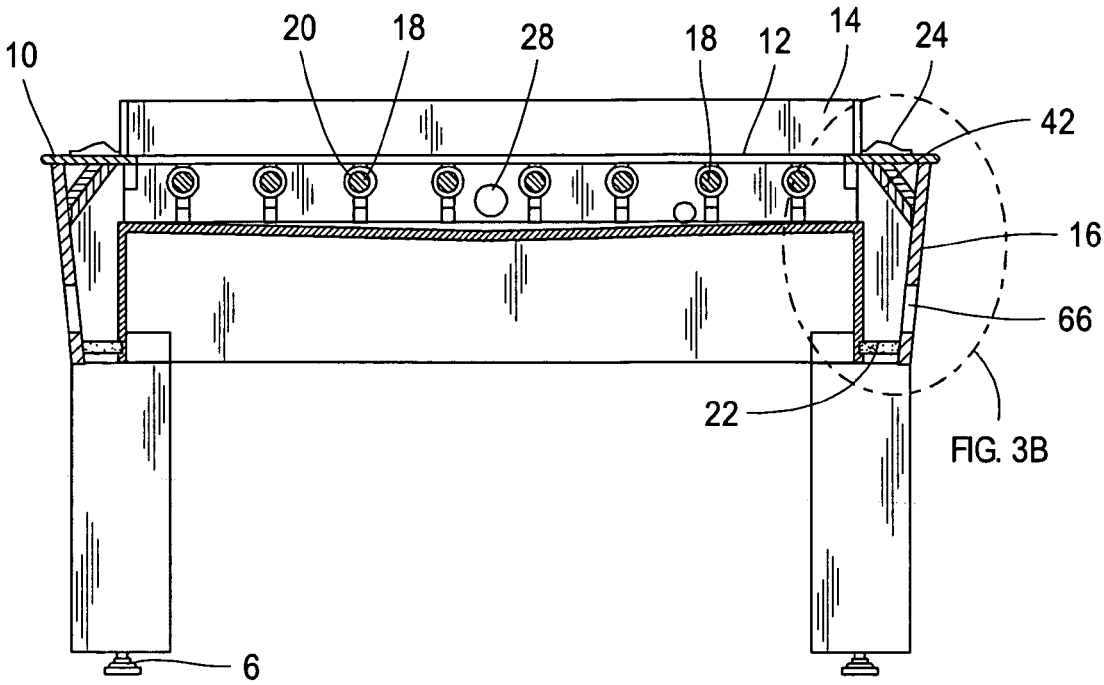
FIG. 3A is a side elevational view of the instant invention.
Figure 3B:
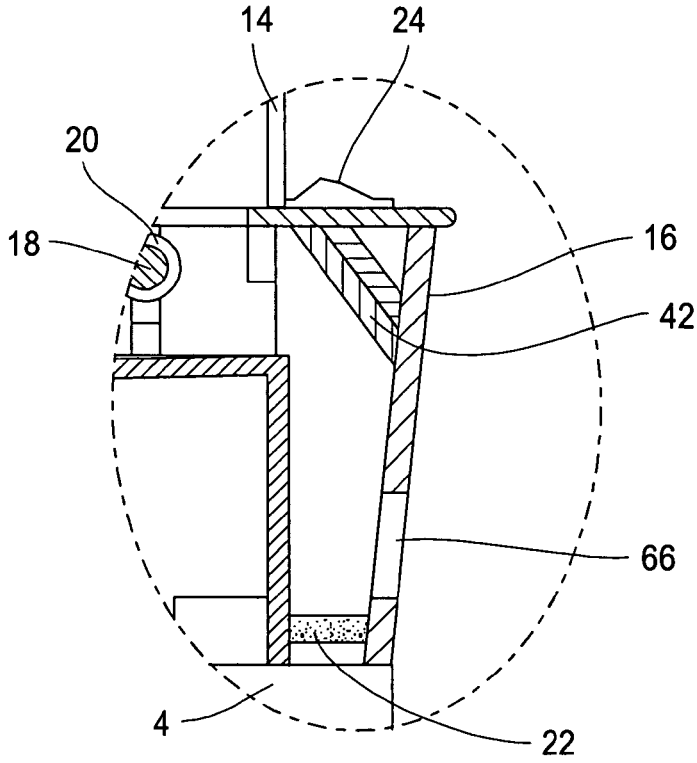
FIG. 3B is a side elevational cut away view of the goal apparatus of the instant invention.
Figure 4:
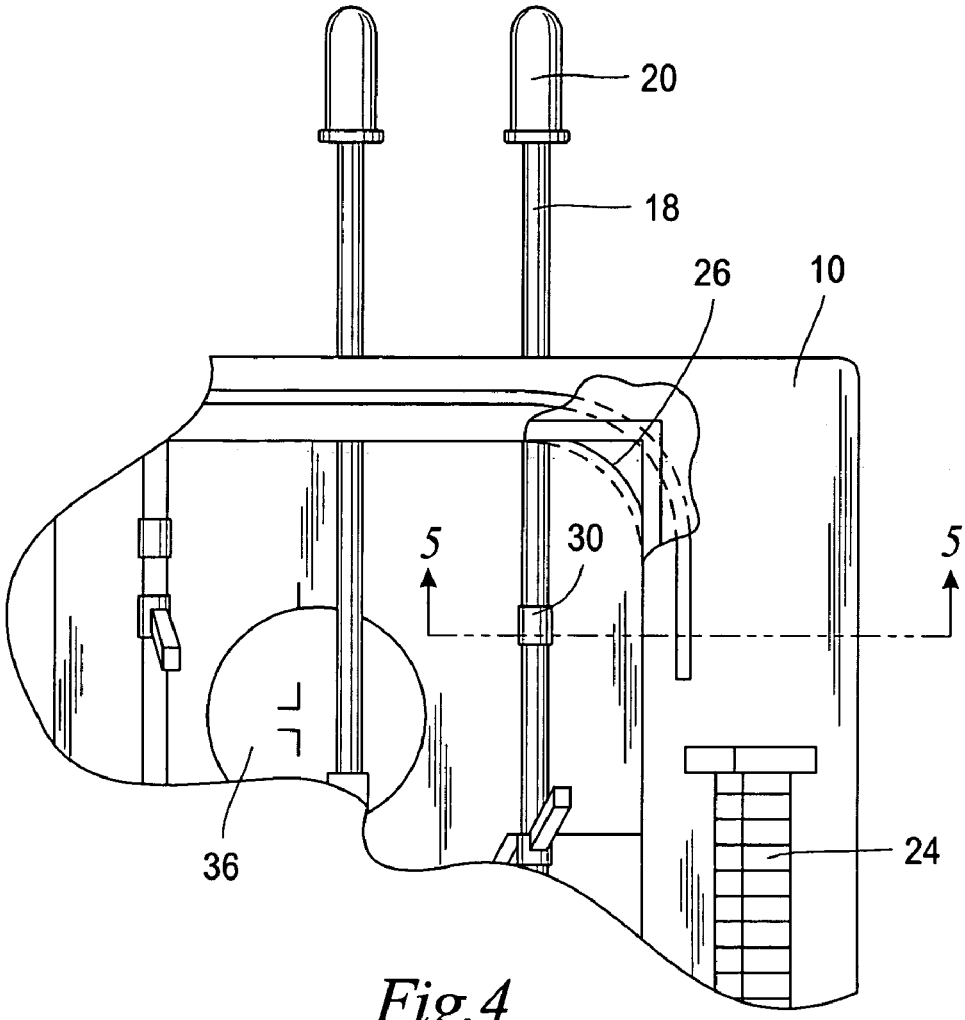
FIG. 4 is a partial top plan view of the instant invention.
Figure 5:
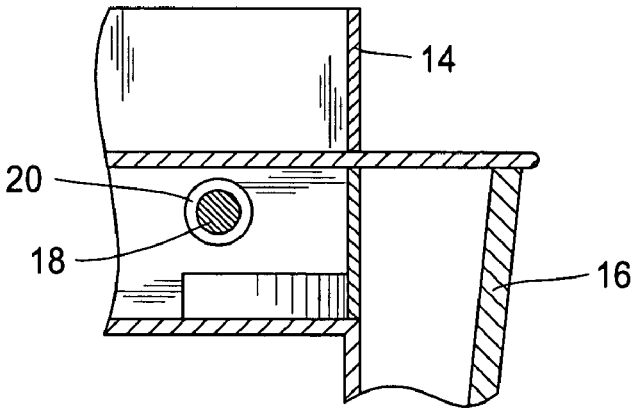
FIG. 5 is a side elevational view of the instant invention.
Figure 6:
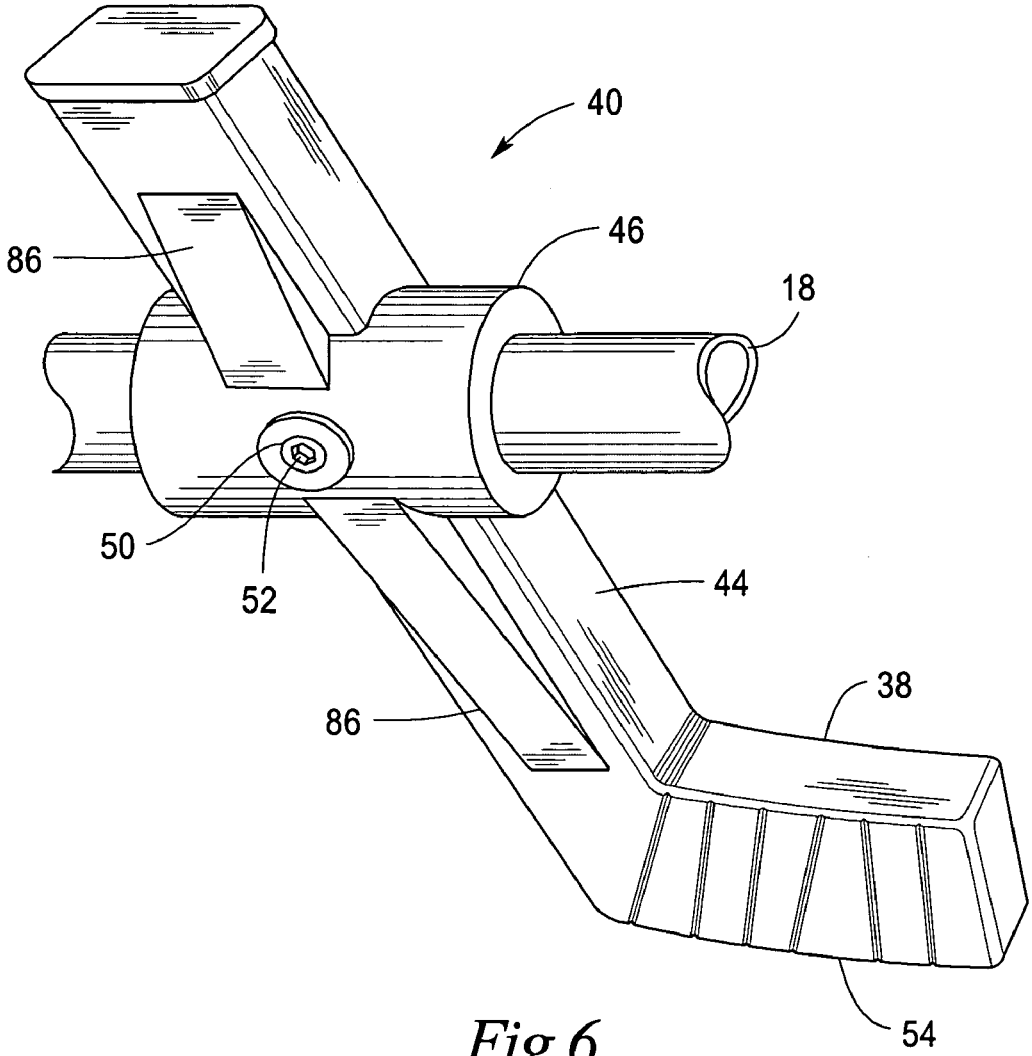
FIG. 6 is a perspective view of the hockey stick in the instant invention.

Referring to FIG. 1, hockey table 2 in the instant invention has legs 4*a*, 4*b*, 4*c*, and 4*d* rigidly connected to body 8. Each leg 4*a*, 4*b*, 4*c* and 4*d* is preferably comprised of a strong and rigid material, such as aluminum or steel, to firmly support body 8. Each leg 4*a*, 4*b*, 4*c*, and 4*d* has a corresponding foot 6*a*, 6*b*, 6*c*, and 6*d* depended from the bottom distal end thereof. Each foot 6*a*, 6*b*, 6*c*, and 6*d* is adjustably attached to each leg 4*a*, 4*b*, 4*c* and 4*d* so as to be able to compensate for an uneven surface supporting each leg 4*a*, 4*b*, 4*c* and 4*d*. In the preferred embodiment, each foot 6*a*, 6*b*, 6*c* and 6*d* is connected by a threaded rod to each leg 4*a*, 4*b*, 4*c* and 4*d*.

Body 8 has a pair of substantially planar sides 56*a* and 56*b* and a pair of substantially planar ends 58*a* and 58*b*. The edge of each planar side 56*a* and 56*b* mates with the corresponding edge of each planar end 58*a* and 58*b*. The respective planar sides 56*a* and 56*b* are rigidly attached to the planar ends 58*a* and 58*b*.

The lower face of planar top 10 is rigidly connected to and is supported by the upper edge of planar sides 56*a* and 56*b* and planar ends 58*a* and 58*b*. Together, planar sides 56*a* and 56*b* and planar ends 58*a* and 58*b* and top 10 form body 8. The top distal end of each leg 4*a*, 4*b*, 4*c* and 4*d* is rigidly connected to, respectively, a mated corner of planar sides 56*a* and 56*b* and planar ends 58*a* and 58*b*. Planar sides 56*a* and 56*b* and the planar ends 58*a* and 58*b* should preferably be constructed from a rigid and rugged material such as plywood or composite wood which form a body 8 with rigidity and resilience.

While planar sides 56*a* and 56*b* and planar ends 58*a* and 58*b* form and define the outer wall of body 8, depending downwardly from an aperture in top 10 is play surface boundary wall 62. Boundary wall 62 is disposed between top 10 and play surface 12. The aperture in top 10 is formed to be substantially parallel and aligned with the perimeter of play surface 12, wherein the inner edge 90 of top 10 overhangs approximately ⅛ inch inwardly over play surface boundary wall 62.

In the preferred embodiment, the aperture in top 10, play surface 12 and boundary wall 62 has curved and rounded corners 26 which directly affects the method of play of the game. Rounded corner 26 has a preferred radius of 5.50 inches and each rounded corner covers 90 degrees.

Players can knock a puck or tuck against a rounded corner 26 of boundary wall 62 thereby either placing the puck or tuck in front of a goal 16 which is formed at each end of playing surface 12, or completely banking against one rounded corner 26 and then banking off a second rounded corner 26 to automatically place the puck or tuck back in play. This rounded corner 26 permits creative and strategically complex play.

A shield 14 depends upwardly from and is rigidly connected to top 10. Shield 14 should preferably be translucent in order to permit full view of playing surface 12 while maintaining puck or tuck within the confines of playing surface 12. Shield 14 should depend upwardly from the top planar face of top 10 and generally is aligned with and is parallel to the perimeter of playing surface 12. Shield 12 may be placed anywhere on top 10, but is preferably disposed nearer the edge of the aperture in top 10 so as to permit the formation of a horizontal surface for use by players. In addition to holding player's materials, such as beverages, at least one score keeping apparatus 24 can be affixed to top 10, which is preferably disposed at an end of table 2. Score keeping apparatus 24 can be any presently known or future developed technology such as mechanical or electronically controlled and may be automatically incremented by connection to goal 16.

Boundary wall 62 has a goal 16 formed in end thereof. The bottom edge of each goal 16 mates with and is aligned with the top surface of playing surface 12. Each goal 16 should preferably be approximately be 6 inches wide and 3 inches high above the top of playing surface 12. A goal ring 64 mates with the edge of the aperture formed in boundary wall 62 which forms the outline of goal 16. Goal ring 64 should preferably be formed of a metallic material to provide an audible sound when puck or tuck makes contact with goal ring 64. This audible sound enhances the game experience as well as helps to protect the aperture edge of goal 16 to provide for longer table 2 life.

Goal 16 is an aperture in boundary wall 62. Aligned directly behind each goal 16, and rigidly disposed within body 8, under top 10 and disposed between respective planar ends 58*a* and 58*b* and boundary wall 62 is a tuck or puck deflector 42. Deflector 42 is angled at approximately a 45 degrees angle so as to deflect the tuck or puck downward, within body 8, to a tuck or puck retrieval area 22. The deflector 42 has a sound damping material affixed to the front surface thereof, facing toward goal 16. Retrieval area 22 is access by through a retrieval area aperture 66 formed in planar end 58*a* and 58*b* of body 8. Retrieval area aperture 66 should preferably be approximately 3 inches high and 6 inches wide to permit easy retrieval of tuck or puck by a player's hand. A retrieval area ring 68 is disposed along the edge of retrieval area aperture 66 to prevent player's hands from being scraped on the edge of aperture 66 and to provide long life to table 2.

At least one tuck or puck insertion tube 28 is disposed at a downward angle of approximately 45 degrees so that tuck or puck will land at approximately in the middle of playing surface 12 approximately midway in the center face-off area 34 which is disposed approximately in the center of planar edges 56*a* and 56*b* and planar ends 58*a* and 58*b*. Center face-off area 34 is marked on playing surface 12 as are a center line 74 and quadrant face off areas 76*a*, 76*b*, 76*c* and 76*d*. Each goal area 88 is also marked as in a normal sport manner.

A plurality of hockey sticks 40 are disposed on and are rigidly affixed to poles 18. Poles 18 are slidably disposed in apertures formed in boundary wall 62 and planar sides 56*a* and 56*b*. A friction reducing bushing 72 may be placed within each aperture 70 to reduce the friction on the movement of poles 18 within each aperture 70 and to provide for long life of table 2.

A grip 20 is rigidly affixed to on a tip 32 of each pole 18 and a travel stop ring or similar apparatus 30 is affixed to the tip 32 of pole 18 opposite from the end of pole 18 with grip 20. Stop ring 30 and grip 20 prevent pole 18 from coming out of pole apertures 70.

A plurality of poles 18 each having at least one stick 40 are disposed over playing surface 12. The number of poles 18 and sticks 40 will vary according to the nature of the game to be played. Generally there will be an equal number of poles 18 and sticks 40 for each player. The grip 20 for each pole for each respective player will be disposed on one respective long edge of playing surface 12.

In a standard hockey game, each player will have one center pole 78 with three sticks 40, a forward pole 80 with three sticks 40, a defense pole 82 with two sticks 40, and a goal pole 84 with one stick.

Each stick 40 has a stick head 38, a stick arm 44 connected at one end to stick head 38, and a stick support 46 connected along stick arm 44, into which stick aperture 52 is formed. Each stick 40 has a connector 50 placed within aperture 52 to connect each stick 40 to each pole 18. Each connector 50 is a screw or rivet that will provide a secure connection between each stick 40 and each pole 18.

Stick support 46 is preferably formed in a barrel form with a central aperture adapted to mate slidably and firmly with each pole 18. Stick support 46 is preferably formed integrally with stick arm 44 for strength and each end of stick support 46 extends approximately one half inch past the outside boundaries of stick arm 44. This extension provides strength and a high level of control and leverage between each pole 18 and each stick 40. A portion of stick arm 44 extends above and below stick support 46 in order to provide balance and strength to stick 40. In the preferred embodiment, stick arm 44 will extend approximately one inch above stick support 46 and will extend approximately one and three quarter inches below stick support 46. Each pole 18 is disposed within each planar edge 56*a* and 56*b* so that each top end of each stick 40 will not touch playing surface 12 upon rotation. Strength arms 86 are integrally formed in stick arm 44 and mate with a wide portion to stick support 46 and taper down to mate with the surface of stick arm 44. Strength arms 86 are formed on opposing sides of stick arm 44, but do not extend passed the outer edges of stick arm 44.

In the preferred embodiment, strength arms 86 extends approximately three fourths of one inch above stick support 46 and one inch below stick support 46 along stick arm 44.

Each stick 40 has a head 44 with a pair of stick faces 54. Each stick face 54 has vertical indentations integrally formed therein to provide for excellent frictional contact and control of the tuck or puck by each stick 40.

In the preferred embodiment, each stick 40 is made from high strength and resilient material such as ABS machine grade plastic with a high density to give each stick 40 long life and to enable each stick to accept great stress without breaking during long terms of rugged use.

The playing surface 12 is angled in a downward direction from each rounded corner 26 toward the center face off area 34 of playing surface 12. This angled playing surface 12 provides for fast and exciting play by keeping the tuck or puck constantly in play and preventing intentional or unintentional trapping of the tuck or puck between each stick 18 and the playing surface 12 and/or boundary wall 62. In the preferred embodiment, the playing surface should be downwardly angled at approximately 4 degrees from each rounded corner 26 over each respective face off areas 76*a, b, c* and *d* toward center face-off area 34.

It is to be understood that while certain forms of the present invention have been illustrated and described herein, it is not to be limited to the specific forms or arrangement of parts described and shown.

What I claim is:

1. A sport game playing apparatus comprising:

a) a playing surface, wherein said playing surface is smooth and provides low friction, said playing surface having four corners and a center area;

b) a retaining wall, having an upper edge and a lower edge and an inside face and an outside face, wherein lower edge of said retaining wall is rigidly connected to, and depending upwardly from, said playing surface, and wherein said inner face of said retaining wall completely surrounds said playing surface and wherein said lower edge of said retaining wall is connected to each of said corners of said playing surface;

c) a plurality of legs, each rigidly connected to, and depending downwardly from, said retaining wall;

d) at least two goal apertures, formed at opposing ends of said retaining wall;

e) a plurality of control members, slidably disposed between opposing sides of said retaning wall not having said goal aperture, each end of each of said control members extending outside of said retaining wall;

f) control handles attached to one side of each control member outside of said retaining wall;

g) end stop members attached to the side of each said control member opposite each said control handle outside of said retaining wall;

h) at least one playing stick rigidly attached to each control member, wherein each playing stick is disposed over said playing surface and within said retaining wall; and k) a top perpendicular to the retaining wall and substantially parallel to the playing surface located adjacent to the upper edge of the retaining wall, the top having an aperture substantially aligned with a perimeter of the playing surface, an inner edge of the top overhangs the retaining wall over the playing surface.

2. A sport game playing apparatus, as recited in claim 1, further comprising a transparent shield rigidly attached to and depending upwardly from said upper edge of said retaining wall.

3. A sport game playing apparatus, as recited in claim 1, wherein each of said control members are metal.

4. A sport game playing apparatus, as recited in claim 1, further comprising a top rigidly connected to and depending upwardly from said upper edge of said retaining wall and disposed exterior to said playing surface, said top having an upper surface, a lower surface, an outside edge and an inside edge.

5. A sport game playing apparatus, as recited in claim 4, further comprising at least one score keeping apparatus rigidly affixed to said upper surface of said top.

6. A sport game playing apparatus, as recited in claim 4, further comprising an exterior retaining wall, having an upper edge, a lower edge, an inside face and an outside face, wherein said upper edge of said exterior retaining wall is rigidly connected to said lower surface of said top, wherein each of said control members are slidably disposed in said exterior retaining wall and each of said control handles and each of said stop members are disposed exterior of said exterior retaining wall.

7. A sport game playing apparatus, as recited in claim 6, further comprising at least one external goal retrieval aperture disposed in said exterior retaining wall.

8. A sport game playing apparatus, as recited in claim 7, further wherein each said external goal retrieval aperture is aligned with each said goal aperture with respect to said center of said playing surface.

9. A sport game playing apparatus, as recited in claim 8, further comprising a goal deflector, disposed between said retaining wall and said exterior retaining wall and is disposed between said goal aperture and said goal retrieval aperture.

10. A sport game playing apparatus, as recited in claim 1, wherein said control handles are comprised of wood.

11. A sport game playing apparatus, as recited in claim 1, wherein said control handles are comprised of plastic.

12. A sport game playing apparatus, as recited in claim 1, wherein each said playing stick has a stick top, a stick base, a support stick rigidly disposed between said stick top and said stick base, said playing stick further comprising an aperture disposed in said stick support for rigid connection to said control member, said stick base having a front face, a rear face, and disposed between said front face and said rear face is a top face edge, a bottom face edge, an inside face end and an outside face end, wherein grooves are formed in said front face and said rear face of said stick base.

13. A sport game playing apparatus, as recited in claim 12, wherein each said stick base has a curved outside face end.

14. A sport game playing apparatus, as recited in claim 12, further comprising angled support members integrally formed on said each said support face of each said stick and wherein each said angled support member is disposed between said stick top and said stick base.

15. A sport game playing apparatus, as recited in claim 12, further comprising means for rigidly connecting said stick through said aperture to said control means.

16. A sport game playing apparatus, as recited in claim 12, wherein said stick top does not extend to said playing surface.

17. A sport game playing apparatus as recited in claim 1 wherein each corner of the vertical retaining wall is curved in a smooth arc manner.

18. A sport game playing apparatus as recited in claim 17 wherein, said playing surface is angled in a downwardly direction from each said corner of said playing surface towards said center of said playing surface.

19. A sport game playing apparatus comprising:

a) playing surface, wherein said playing surface is smooth and provides low friction, said playing surface having four corners and a center area;

b) a retaining wall, having an upper edge and a lower edge and an inside face and an outside face, wherein lower edge of said retaining wall is rigidly connected to, and depending upwardly from, said playing surface, and wherein said inner face of said retaining wall completely surrounds said playing surface and wherein said lower edge of said retaining wall is connected to each of said corners of said playing surface;

c) a plurality of legs, each rigidly connected to, and depending downwardly from, said retaining wall;

d) at least two goal apertures, formed at opposing ends of said retaining wall;

e) a plurality of control members, slidably disposed between opposing sides of said retaining wall not having said goal aperture, each end of each of said control members extending outside of said retaining wall;

f) control handles attached to one side of each control member outside of said retaining, wall;

g) end stop members attached to the side of each said control member opposite each said control handle outside of said retaining wall;

h) at least one playing stick rigidly attached to each control member, wherein each playing stick is disposed over said playing surface and within said retaining wall;

i) wherein each said corner of said vertical retaining wall is curved in a smooth arc manner;

j) wherein, said playing surface is angled in a downwardly direction from each said corner of said playing surface towards said center of said playing surface;

k) at least one playing piece insertion aperture in said retaining wall, and is disposed above said playing surface, wherein said playing piece insertion aperture is angled downwardly toward said playing surface.

20. A sport game playing apparatus comprising:

a) a playing surface, wherein said playing surface is smooth and provides low friction, said playing surface having four corners and a center area;

b) a retaining wall, having an upper edge and a lower edge and an inside face and an outside face, wherein lower edge of said retaining wall is rigidly connected to, and depending upwardly from, said playing surface, and wherein said inner face of said retaining wall completely surrounds said playing surface and wherein said lower edge of said retaining wall is connected to each of said corners of said playing surface;

c) a plurality of legs, each rigidly connected to, and depending downwardly from, said retaining wall;

d) at least two goal apertures, formed at opposing ends of said retaining wall;

e) plurality of control members, slidably disposed between opposing sides of said retaining wall not having said goal aperture, each end of each of said control members extending outside said retaining wall;

f) control handles attached to one side of each control member outside of said retaining wall;

g) end stop members attached to the side of each said control member opposite each said control handle outside of said retaining wall;

h) at least one playing stick rigidly attached to each control member, wherein each playing stick is disposed over said playing surface and within said retaining wall;

i) wherein each said corner of said vertical retaining wall is curved in a smooth arc manner;

j) wherein, said playing surface is angled in a downwardly direction from each said corner of said playing surface towards said center of said playing surface;

k) a metal ring disposed around the exterior of each said goal retrieval aperture and wherein said metal ring is rigidly attached to said exterior retaining wall.

* * * * *